US006938356B2

(12) United States Patent
Nagae et al.

(10) Patent No.: US 6,938,356 B2
(45) Date of Patent: Sep. 6, 2005

(54) DRYING MACHINE

(75) Inventors: Etsushi Nagae, Oizumi-machi (JP); Hiroshi Mukaiyama, Oizumi-machi (JP); Koji Ono, Oizumi-machi (JP); Masaya Tadano, Nitta-machi (JP); Tetsuya Masuda, Ota (JP); Kazuyoshi Tomochika, Oizumi-machi (JP); Takahiro Nakamura, Ota (JP); Masakatsu Morishige, Otsu (JP); Harumi Takeuchi, Otsu (JP); Kiyokazu Fujikawa, Shiga (JP); Tamotsu Kawamura, Youkaichi (JP); Motohiko Kosano, Isesaki (JP); Shinichi Akiyama, Otsu (JP); Nobuo Koumoto, Otsu (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/932,310

(22) Filed: Sep. 2, 2004

(65) Prior Publication Data

US 2005/0086827 A1 Apr. 28, 2005

(30) Foreign Application Priority Data

Sep. 5, 2003 (JP) ..... 2003-314045

(51) Int. Cl.[7] ..... F26B 21/06

(52) U.S. Cl. ..... 34/77; 34/218

(58) Field of Search ..... 34/61, 77, 204, 34/215, 219; 62/114, 298

(56) References Cited

U.S. PATENT DOCUMENTS 2,326,512 A * 8/1943 Andrews ..... 159/12
5,119,571 A * 6/1992 Beasley ..... 34/446
5,343,632 A * 9/1994 Dinh ..... 34/507

(Continued)

FOREIGN PATENT DOCUMENTS

JP 11-99299 4/1999

*Primary Examiner*—Stephen Gravini
(74) *Attorney, Agent, or Firm*—McDermott Will & Emery LLP

(57) ABSTRACT

A washing/drying machine has objects to shorten a time required for a washing operation, to improve a heat exchange capability in a radiator and an evaporator, and to shorten a drying time for things to be dried, and comprises: an accommodating chamber in which things to be washed (things to be dried) are accommodated and in which a drying operation of the things to be washed is performed; a refrigerant circuit in which a compressor, a gas cooler, a decompression device, an evaporator and the like are successively connected to one another in an annular form via a piping and in which carbon dioxide is used as a refrigerant and which has a supercritical pressure on a high pressure side thereof; and blower means for blowing air which has exchanged heat with the radiator into the accommodating chamber to allow the air passed through the accommodating chamber to exchange the heat with the evaporator, wherein the blower means constitutes a circulation direction of the air passed through the gas cooler, and that of the refrigerant flowing in the gas cooler in such a manner as to form a counter-flow, and constitutes a circulation direction of the air passed through the evaporator, and that of the refrigerant flowing in the evaporator in such a manner as to form a counter-flow.

5 Claims, 3 Drawing Sheets

U.S. PATENT DOCUMENTS 5,564,277 A * 10/1996 Martin ..... 62/50.3
5,675,906 A * 10/1997 Li et al. ..... 34/77
6,321,460 B1 * 11/2001 Jin ..... 34/77
2005/0044744 A1 * 3/2005 Tadano et al. ..... 34/596

* cited by examiner

DRYING MACHINE

BACKGROUND OF THE INVENTION

1. Field of the Invention

The present invention relates to a drying machine including an accommodating chamber in which things to be dried are accommodated and in which drying of the things to be dried is executed.

2. Description of the Related Art

In a drying machine, an electric heater or a gas combustor has heretofore been used as a heat source. After heating outside air by the electric heater or the gas combustor to obtain high-temperature air, the air is blown into an accommodating chamber in which things to be dried, such as clothes, are accommodated, and the things to be dried in the accommodating chamber are dried. Moreover, the high-temperature air in the accommodating chamber, by which the things to be dried have been dried, is exhausted to the outside.

However, in the drying machine in which the electric heater, the gas combustor or the like is used, outside air outside the accommodating chamber is used in the high-temperature air blown into the accommodating chamber, and therefore there is a problem that a drying time largely change by conditions of the outside air. High-temperature/humidity air which has come out of the accommodating chamber is exhausted to the outside, and therefore a problem has also occurred that temperature or humidity of a place where the drying machine is installed rises.

To solve the problem, a clothes drying machine has also been developed in which a heating pump constituted of a compressor, a heating coil, an expansion valve, and a cooling coil and capable of circulating a heat exchange medium, the things to be dried are dried by the high-temperature air heated by the heating coil, and moisture evaporated from the dried things is coagulated and discarded by the cooling coil (see, for example, Japanese Patent Application Laid-Open No. 11-99299).

By the use of the heating pump, it can be expected that a time required for drying the things to be dried is shortened and energy efficiency is raised, but there has been an earnest demand for further reduction of the drying time.

On the other hand, in the drying machine on which this type of the heating pump is mounted, a circulation direction of a refrigerant flowing in heat exchangers such as a heating coil and a cooling coil and a circulation direction of air which exchanges heat with the refrigerant have not been especially studied in the present situation.

SUMMARY OF THE INVENTION

According to the present invention, there is provided a drying machine comprising: an accommodating chamber in which things to be dried are accommodated and in which a drying operation of the things to be dried is performed; a refrigerant circuit in which a compressor, a radiator, a decompression device, and an evaporator are successively connected to one another in an annular form via a piping and in which carbon dioxide is used as a refrigerant and which has a supercritical pressure on a high pressure side thereof; and blower means for blowing air which has exchanged heat with the radiator into the accommodating chamber to allow the air passed through the accommodating chamber to exchange the heat with the evaporator. The blower means constitutes a circulation direction of the air passed through the radiator, and a circulation direction of the refrigerant flowing in the radiator in such a manner as to form a counter-flow.

According to the present invention, the drying machine includes the accommodating chamber in which the things to be dried are accommodated and in which the drying operation of the things to be dried is performed. The drying machine comprises: the refrigerant circuit in which the compressor, radiator, decompression device, evaporator and the like are successively connected to one another in the annular form via the piping and in which carbon dioxide is used as the refrigerant and which has the supercritical pressure on the high pressure side thereof; and the blower means for blowing the air which has exchanged the heat with the radiator into the accommodating chamber to allow the air passed through the accommodating chamber to exchange the heat with the evaporator. By the blower means, the circulation direction of the air passed through the radiator, and that of the refrigerant flowing through the radiator constitute the counter-flow. Therefore, since the air is heated by the radiator and dehumidified by the evaporator, the things to be dried can be efficiently dried.

Especially, since the refrigerant circuit has the supercritical pressure on the high pressure side thereof, the passed air and the refrigerant in the radiator constitute the counter-flow, a difference in temperature between the air being passed through the radiator and the radiator at this time is set to be substantially constant, and a heat exchange efficiency between the refrigerant and the air in the radiator can be improved.

Moreover, in the drying machine of the present invention, in the above-described invention, the circulation direction of the air passed through the radiator is directed upwards from below, and the circulation direction of the refrigerant flowing in the radiator is directed downwards from above.

According to the present invention, additionally, the air passed through the radiator is circulated upwards from below, and the refrigerant flowing in the radiator is circulated downwards from above. The air whose temperature has risen tries to flow upwards by natural convection. Therefore, when the air is circulated upwards from below with respect to the radiator, the air easily flows.

On the other hand, when the refrigerant is circulated downwards from above in the radiator, oil contained in the refrigerant discharged from the compressor is not easily accumulated in the radiator, and the oil is smoothly returned to the compressor.

Moreover, according to the present invention, there is provided a drying machine comprising: an accommodating chamber in which things to be dried are accommodated and in which a drying operation of the things to be dried is performed; a refrigerant circuit in which a compressor, a radiator, a decompression device, an evaporator and the like are successively connected to one another in an annular form via a piping and in which carbon dioxide is used as a refrigerant and which has a supercritical pressure on a high pressure side thereof; and blower means for blowing air which has exchanged heat with the radiator into the accommodating chamber to allow the air passed through the accommodating chamber to exchange the heat with the evaporator. The blower means constitutes a circulation direction of the air passed through the evaporator, and a circulation direction of the refrigerant flowing in the evaporator in such a manner as to form a counter-flow.

According to the present invention, the drying machine includes the accommodating chamber in which the things to be dried are accommodated and in which the drying operation of the things to be dried is performed. The drying machine comprises: the refrigerant circuit in which the compressor, radiator, decompression device, evaporator and the like are successively connected to one another in the annular form via the piping and in which carbon dioxide is used as the refrigerant and which has the supercritical pressure on the high pressure side thereof; and the blower means for blowing the air which has exchanged the heat with the radiator into the accommodating chamber to allow the air passed through the accommodating chamber to exchange the heat with the evaporator. By the blower means, the circulation direction of the air passed through the evaporator, and that of the refrigerant flowing through the evaporator constitute the counter-flow. Therefore, since the air is heated by the radiator and dehumidified by the evaporator, the things to be dried can be efficiently dried.

Moreover, in the drying machine of the present invention, in the above-described invention, the circulation direction of the air passed through the evaporator is directed downwards from above, and the circulation direction of the refrigerant flowing in the evaporator is directed upwards from below.

According to the present invention, additionally, the air passed through the evaporator is circulated downwards from above, and the refrigerant flowing in the evaporator is circulated upwards from below. Since the air is passed downwards from above, dew condensation water attached to the evaporator easily flow downwards.

Moreover, in the drying machine of the present invention, in the above-described inventions, the radiator and the evaporator are constituted of fin and tube type heat exchangers, and the air is passed in length directions of fins of the radiator and the evaporator by the blower means.

According to the present invention, in addition to the above-described inventions, the radiator and the evaporator are constituted of the fin and tube type heat exchangers, and the air is passed in the length directions of the fins of the radiator and the evaporator by the blower means. Therefore, the heat of the air can be efficiently exchanged using the whole radiator or evaporator, and a heat exchange efficiency can further be enhanced.

DETAILED DESCRIPTION OF THE PREFERRED EMBODIMENT

According to the present invention, to solve the problems of conventional techniques, there is provided a drying machine in which heat exchanging capabilities in a radiator and an evaporator are improved, so that a drying time of things to be dried can be shortened. An embodiment of the present invention will be described hereinafter with reference to the drawings.

Figure 1:
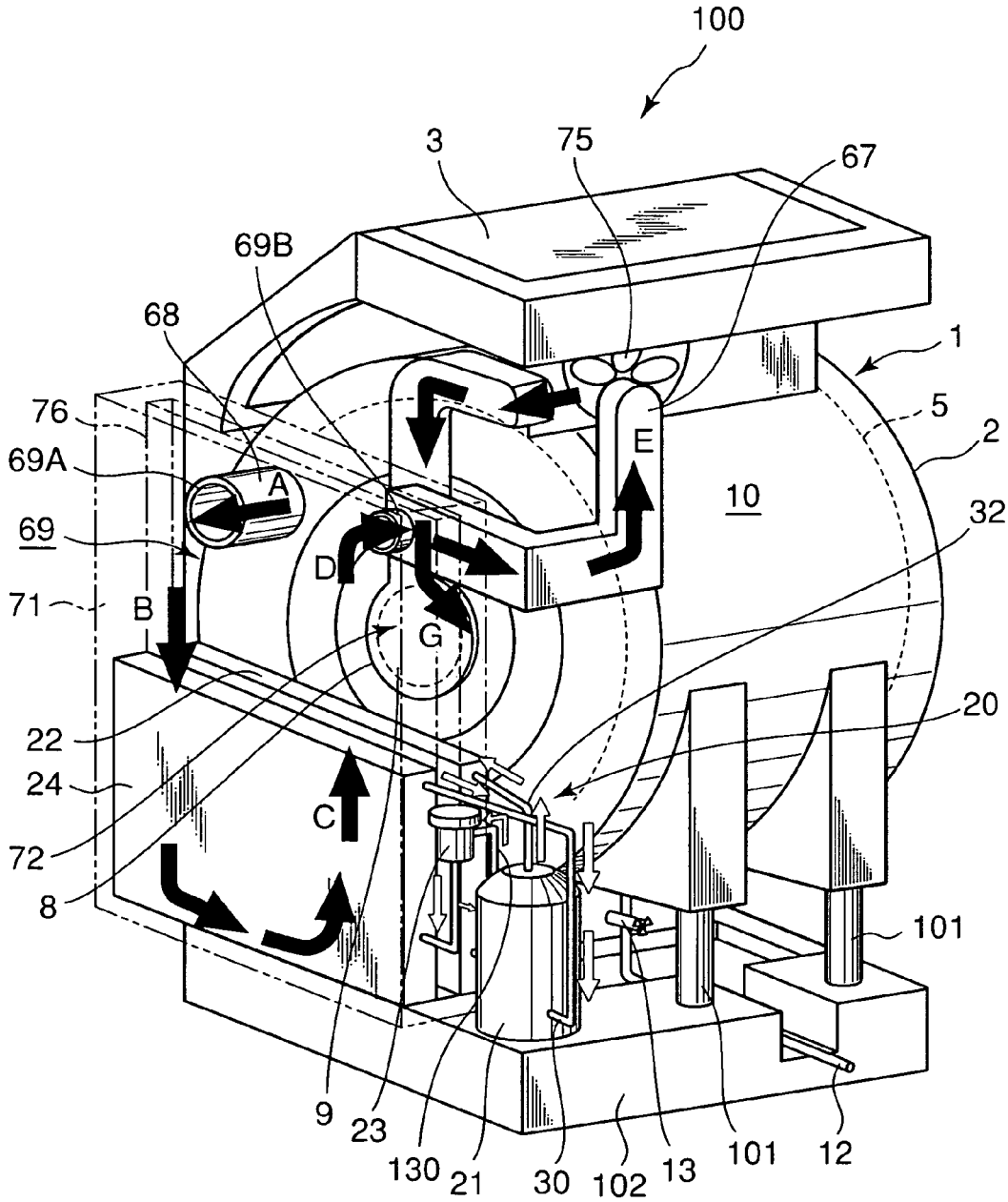
FIG. 1 is an inner constitution diagram of a washing/drying machine according to an embodiment of the present invention.

FIG. 1 shows an inner constitution diagram of a washing/drying machine 100 which is one embodiment of a drying machine of the present invention and which performs, for example, a washing operation and a drying operation after end of the washing operation. The washing/drying machine 100 is used to washing and drying things to be washed (the things to be washed turn to things to be dried in the drying operation) such as clothes. An opening/closing door 3 for inserting/removing the things to be washed is attached to a middle portion of the upper surface of a main body 1 (in FIG. 1, a case of the main body 1 is seen through) forming an outer structure, and an operation panel (not shown) in which various operation switches and a display portion are disposed is disposed on the upper surface of the main body 1 beside the opening/closing door 3.

A cylindrical resin outer drum 2 capable of storing water is disposed in the main body 1, and the outer drum 2 is disposed with respect to an axis of a cylinder which is a right/left direction. Moreover, a cylindrical stainless steel inner drum 5 which serves both as a washing tank and a spin-drying tank is disposed inside the outer drum 2. The inside of the inner drum 5 is constituted as an accommodating chamber 10 in which the things to be washed are accommodated, and is also disposed with respect to the axis of the cylinder which is the right/left direction. The axis is connected to a shaft 8 of a driving motor (not shown) attached to a side wall (inner side of FIG. 1) of the outer drum 2, and the inner drum 5 is held rotatably in the outer drum 2 centering on the shaft 8. Since the outer drum 2 causes vibration/displacement by rotation of the inner drum 5, the drum is fixed onto a base 102 positioned on the bottom surface of the main body 1 via suspensions 101 having a vibration absorbing function in order to reduce vibrations/noises.

A watertight opening/closing lid (not shown) for inserting/removing the things to be washed is disposed corresponding to the opening/closing door 3 in an upper part of the outer drum 2. A large number of through-holes (not shown) via which air and water can circulate are formed in a whole peripheral wall of the inner drum 5. A stopping position of the inner drum 5 is defined, and an opening/closing lid (not shown) for inserting/removing the things to be washed is disposed in a position (upper surface) of the inner drum corresponding to the opening/closing lid of the outer drum 2 at the time of stopping.

The driving motor is a motor for rotating the inner drum 5 centering on the shaft 8 in the right/left horizontal direction in a washing operation and a drying operation after end of the washing operation. The driving motor is attached to one end (inner side of FIG. 1) of the shaft 8, and is controlled by a control device (not shown) in such a manner as to rotate the inner drum 5 at a low speed at the time of the drying operation as compared with the washing operation.

A hollow portion 9 whose inner portion is formed to be hollow is formed in the other end (front side of FIG. 1) of the shaft 8, and an air circulation path 72 described later is connected into the inner drum 5 via the hollow portion 9.

A water supply passage (not shown) which is water supply means for supplying water into the inner drum 5 is disposed in the upper part of the main body 1, and one end of the water supply passage is connected to a water source of tap water or the like via a water supply valve. The water supply valve is controlled to open/close by the control device. The other end of the water supply passage is connected to the outer drum 2 to communicate with the inside of the drum, and is constituted in such a manner that water (tap water) is supplied to the accommodating chamber 10 in the inner drum 5 disposed in the outer drum 2 from the water source, when the water supply valve is opened by the control device.

A draining passage 12 which is draining means for discharging the water of the accommodating chamber 10 in the inner drum 5 is disposed in a lower part of the main body 1, and one end of the draining passage 12 communicates with a bottommost portion of the outer drum 2 via a draining valve 13 (also constituting the draining means) which is controlled to open/close by the control device. The other end of the draining passage 12 is derived to the outside of the washing/drying machine 100, and extends to a drain ditch or the like.

On the other hand, in the washing/drying machine 100, an air circulation path 72 is constituted extending laterally from a rear side of the outer drum 2 in the main body 1. The air circulation path 72 is constituted of a duct member 67 on a discharge side, a duct member 68 on a suction side, an air passage 69 formed in a dust box 71 and the like. One end of the duct member 67 is connected to the inner drum 5 (accommodating chamber 10) via the hollow portion 9 formed in the other end (front side of FIG. 1) of the shaft 8, and the other end thereof is connected to an outlet 69B of the air passage 69 formed in the dust box 71. The duct member 68 connects the inner drum 5 (accommodating chamber 10) in the outer drum 2 to an inlet 69A of the air passage 69.

Moreover, a blower 75, described later, which is blower means is disposed in the duct member 67 of the air circulation path 72. The blower 75 supplies air in the air circulation path 72 into the accommodating chamber 10 in the inner drum 5 from the duct member 67 of the air circulation path 72 via the hollow portion 9 of the shaft 8. That is, in the washing/drying machine 100, at the time of the drying operation, the air in the air circulation path 72 is circulated in the inner drum 5 by the blower 75 to thereby heat the air by heat exchange with the gas cooler 22 (radiator) disposed in the air passage 69 of the air circulation path 72. The air is discharged into the accommodating chamber 10 in the inner drum 5 (arrow G of FIG. 1). It is to be noted that in FIG. 1, black arrows show a circulation direction of the air, and white arrows indicate a circulation direction of a refrigerant of a refrigerant circuit 20.

The air passage 69 is formed in the dust box 71 as described above. As shown in FIG. 1, the dust box 71 is partitioned on the front side and on the inner side by an insulating partition member 76 in a state in which a lower part of the box is not partitioned. Accordingly, a series of detouring air passage 69 is constituted in such a manner that the passage extends downwards from above on the front side, and rises from below on the inner side. Moreover, an evaporator 24 of the refrigerant circuit 20 is disposed on the front side of the air passage 69, and a gas cooler 22 of the refrigerant circuit 20 is disposed on the inner side.

It is to be noted that as described above, portions below the gas cooler 22 and the evaporator 24 are not partitioned by the duct member 67, and communicate with each other. Moreover, the inlet 69A of the air passage 69 opens in an upper part of the air passage 69 on the front side of the dust box 71. Accordingly, the duct member 68 communicates with the upper part of the air passage 69 on the front side of the dust box 71. The outlet 69B of the air passage 69 opens in the upper part of the air passage 69 on the inner side of the dust box 71. Accordingly, the duct member 67 communicates with the upper part of the air passage 69 on the inner side of the dust box 71.

By the constitution, by the operation of the blower 75, the air circulated in the accommodating chamber 10 to dry the things to be washed flows in the air passage 69 of the dust box 71 on the front side from the inlet 69A via the duct member 68 of the air circulation path 72 while flowing downwards (arrow A of FIG. 1). The air exchanges heat with the evaporator 24 disposed in the air passage 69 on the front side, and is cooled (arrow B of FIG. 1). After the air is dehumidified, the air enters the air passage 69 of the dust box 71 on the inner side from below the partition member 76, flows upwards while exchanging the heat with the gas cooler 22 disposed on the air passage 69 on the inner side, and is heated (arrow C of FIG. 1). Thereafter, the air flows out of the outlet 69B to enter the duct member 67, is drawn in the blower 75 disposed in the member (arrow E of FIG. 1), and is blown into the accommodating chamber 10 from the blower 75 (arrow G of FIG. 1).

Next, reference numeral 20 denotes the refrigerant circuit, and the refrigerant circuit 20 is constituted by successively connecting a compressor 21, the gas cooler 22, an expansion valve 23 which is a decompression device, the evaporator 24 and the like to one another in an annular form via a piping. Moreover, the compressor 21 or the dust box 71 in which the expansion valve 23, gas cooler 22, and evaporator 24 are built are fixed onto the base 102. A predetermined amount of carbon dioxide ($CO_2$) is sealed as a refrigerant in the refrigerant circuit 20. Here, the compressor 21 for use in the present embodiment is a rotary compressor of an inner intermediate pressure type multistage compression system, and an electromotive element, and a first rotary compression element (first stage) and a second rotary compression element (second stage) driven by the electromotive element are disposed in an airtight container (not shown).

Moreover, a low-pressure refrigerant is introduced into the first rotary compression element of the compressor 21 from a refrigerant guide pipe 30, and a high-temperature/pressure refrigerant compressed by the second rotary compression element is discharged to the outside of the compressor 21 from a refrigerant discharge pipe 32.

The refrigerant discharge pipe 32 of the compressor 21 of the refrigerant circuit 20 is connected to the inlet of the gas cooler 22 for heating the air. A piping 130 extending out of the gas cooler 22 is connected to an inlet of the expansion valve 23. The piping extending out of the expansion valve 23 reaches the inlet of the evaporator 24, and the piping extending out of the evaporator 24 is connected to the refrigerant guide pipe 30 and reaches the compressor 21. The operation of the compressor 21, and the expansion valve 23 are controlled by the control device.

It is to be noted that the above-described control device is control means for controlling the washing/drying machine 100, and controls operating of the driving motor (not shown), opening/closing of the water supply valve of the water supply passage, opening/closing of the draining valve 13 of the draining passage 12, operating of the compressor 21, throttle adjusting of the expansion valve 23, and an air amount of the blower 75. Furthermore, the control device also controls the temperature of the air passed through the gas cooler 22 in order to prevent the things to be washed accommodated in the inner drum 5 from being discolored or damaged.

Figure 2:
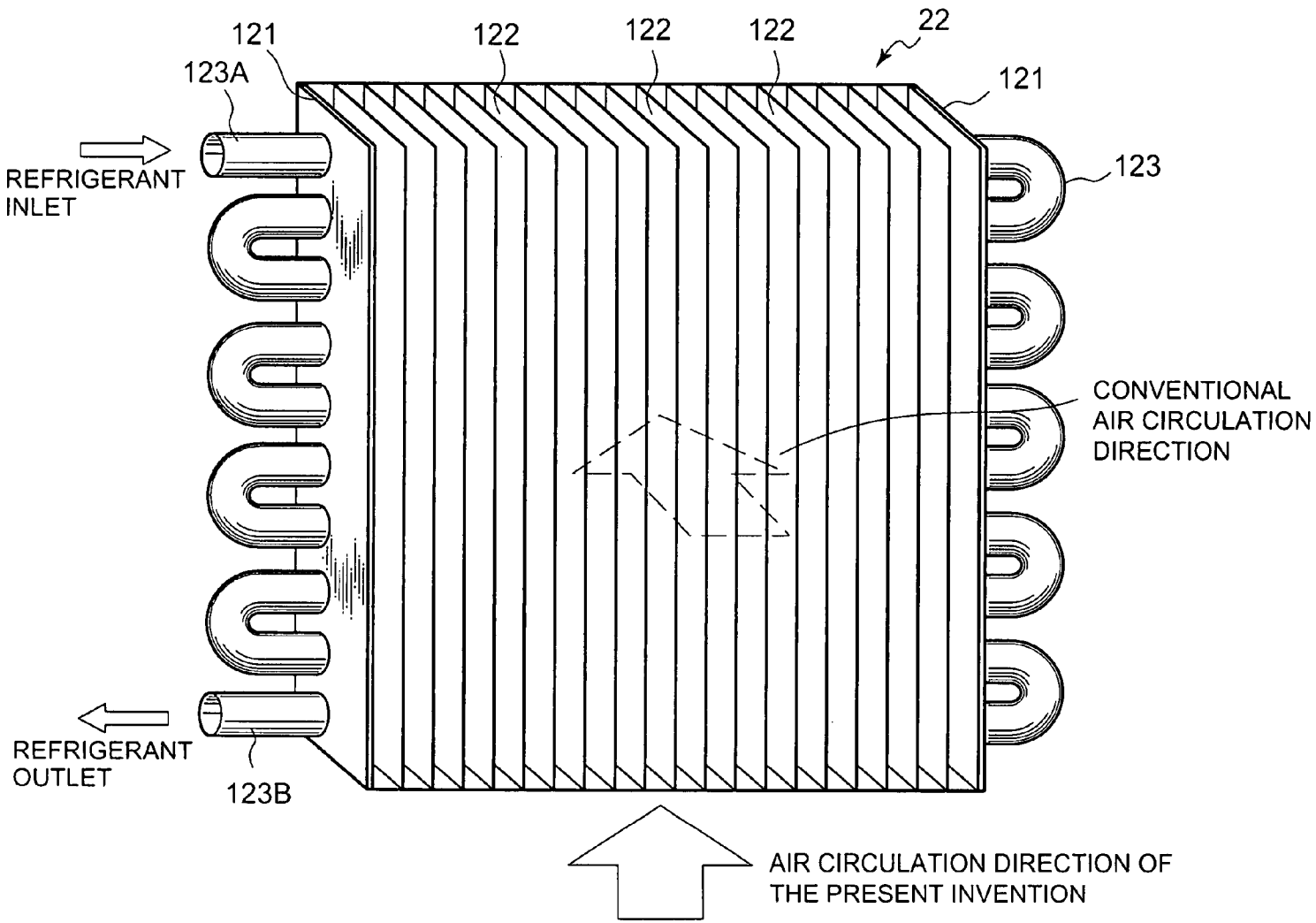
FIG. 2 is an enlarged view of a gas cooler of the washing/drying machine of FIG. 1.

Here, the gas cooler 22 is a so-called fin and tube type heat exchanger, and is constituted of: tube plates 121, 121 formed of steel plates on opposite ends; a large number of fins 122 . . . for the heat exchange, formed of aluminum thin plates arranged at predetermined intervals between the opposite tube plates 121, 121; and meandering refrigerant pipings 123 extending through the respective fins 122 . . . and formed of steel tubes attached to the opposite tube plates 121, 121 as shown in FIG. 2. One end (upper end) 123A of the refrigerant piping 123 is connected to the refrigerant discharge pipe 32 from the compressor 21, and the other end (lower end) 123B is connected to the refrigerant piping 130.

Moreover, the refrigerant passing through the refrigerant piping 123 of the gas cooler 22 changes the heat with the air passed through the gas cooler 22, and is cooled by the blower 75. A circulation direction (rising upwards from below) of the air passed through the gas cooler 22 by the blower 75, and a circulation direction (downward from below) of the refrigerant flowing through the gas cooler 22 are set in such a manner as to constitute a counter-flow.

That is, the washing/drying machine 100 of the present embodiment is constituted in such a manner that the air passed through the gas cooler 22 is circulated upwards from below as shown in FIG. 1 (arrow C of FIG. 1), and the refrigerant flowing in the gas cooler 22 is circulated downwards from above.

Here, a conventional refrigerant circuit has heretofore been constituted in such a manner that the circulation direction of the refrigerant flowing in the gas cooler 22 usually crosses that of the air passed through the gas cooler 22 by the blower 75 at right angles as shown by a broken arrow of FIG. 2.

However, as in the washing/drying machine 100 of the present invention, the circulation direction of the air passed through the gas cooler 22 by the blower 75, and the circulation direction of the refrigerant flowing through the gas cooler 22 are constituted to form the counter-flow. Accordingly, the heat can be efficiently exchanged between the air and the refrigerant in the gas cooler 22.

This is because the refrigerant is not liquefied (the refrigerant has a supercritical state) in the gas cooler 22 with the use of the refrigerant which brings about a supercritical pressure on the high pressure side of the refrigerant circuit, for example, carbon dioxide. The passed air and the refrigerant of the gas cooler 22 are allowed to flow in the opposite directions, and accordingly the difference in temperature between the air and the refrigerant can be set to be substantially constant in the process of passage through the gas cooler 22. That is, the temperature of the refrigerant is highest in one end 123A of the refrigerant piping 123 of the gas cooler 22, and the temperature of the refrigerant gradually drops toward the other end 123B. On the other hand, the air has a lowest temperature under the gas cooler 22, gradually heated by the refrigerant while flowing upwards, and has a highest temperature in the outlet of the gas cooler 22. Therefore, the passed air and the refrigerant of the gas cooler form the counter-flow, the difference in temperature between the air and the refrigerant is substantially constant in the process of the passage through the gas cooler 22, and a heat exchange efficiency can be improved. This can shorten a drying time of the washing/drying machine 100.

Moreover, as shown in FIG. 2, when the air is passed in a length direction of the fins 122 of the gas cooler 22 by the blower 75, the air can more efficiently exchange the heat using the whole gas cooler 22.

Furthermore, the air whose temperature has been raised tries to flow upwards by natural convection. Therefore, when the air is circulated upwards from below with respect to the gas cooler 22, the air further smoothly flows.

On the other hand, when the refrigerant is circulated downwards from above in the gas cooler 22, oil (lubricating oil of the compressor 21) discharged together with the refrigerant from the compressor 21 is not easily accumulated in the gas cooler 22, and the oil smoothly returns to the compressor 21.

On the other hand, the evaporator 24 is also a fin and tube type heat exchanger in the same manner as in the gas cooler 22. The evaporator is constituted of: tube plates 141, 141 formed of steel plates on opposite ends; a large number of fins 142 . . . for the heat exchange, formed of aluminum thin plates arranged at predetermined intervals between the opposite tube plates 141, 141; and meandering refrigerant pipings 143 extending through the respective fins 142 . . . and formed of steel tubes fixed to the tube plates 141, 141. The refrigerant which passes through the refrigerant piping 143 of the evaporator 24 exchanges the heat with the air passed through the evaporator 24 by the blower 75, the heat is taken by the air, and the refrigerant evaporates. Moreover, the evaporator is installed in such a manner that the circulation direction of the air passed through the evaporator 24 by the blower 75, and the circulation direction of the refrigerant flowing in the evaporator 24 form the counter-flow (FIG. 3).

In the washing/drying machine 100 of the present embodiment, as shown in FIG. 1, the evaporator is installed in such a manner that the air passed through the evaporator 24 is circulated in the downward direction from above (arrow B of FIG. 1) and the refrigerant flowing in the evaporator 24 is circulated in the upwards direction from below.

By the constitution in which the circulation direction of the air passed through the evaporator 24 by the blower 75, and the circulation direction of the refrigerant flowing in the evaporator 24 form the counter-flow, the air and the refrigerant in the evaporator 24 can efficiently exchange the heat.

Figure 3:
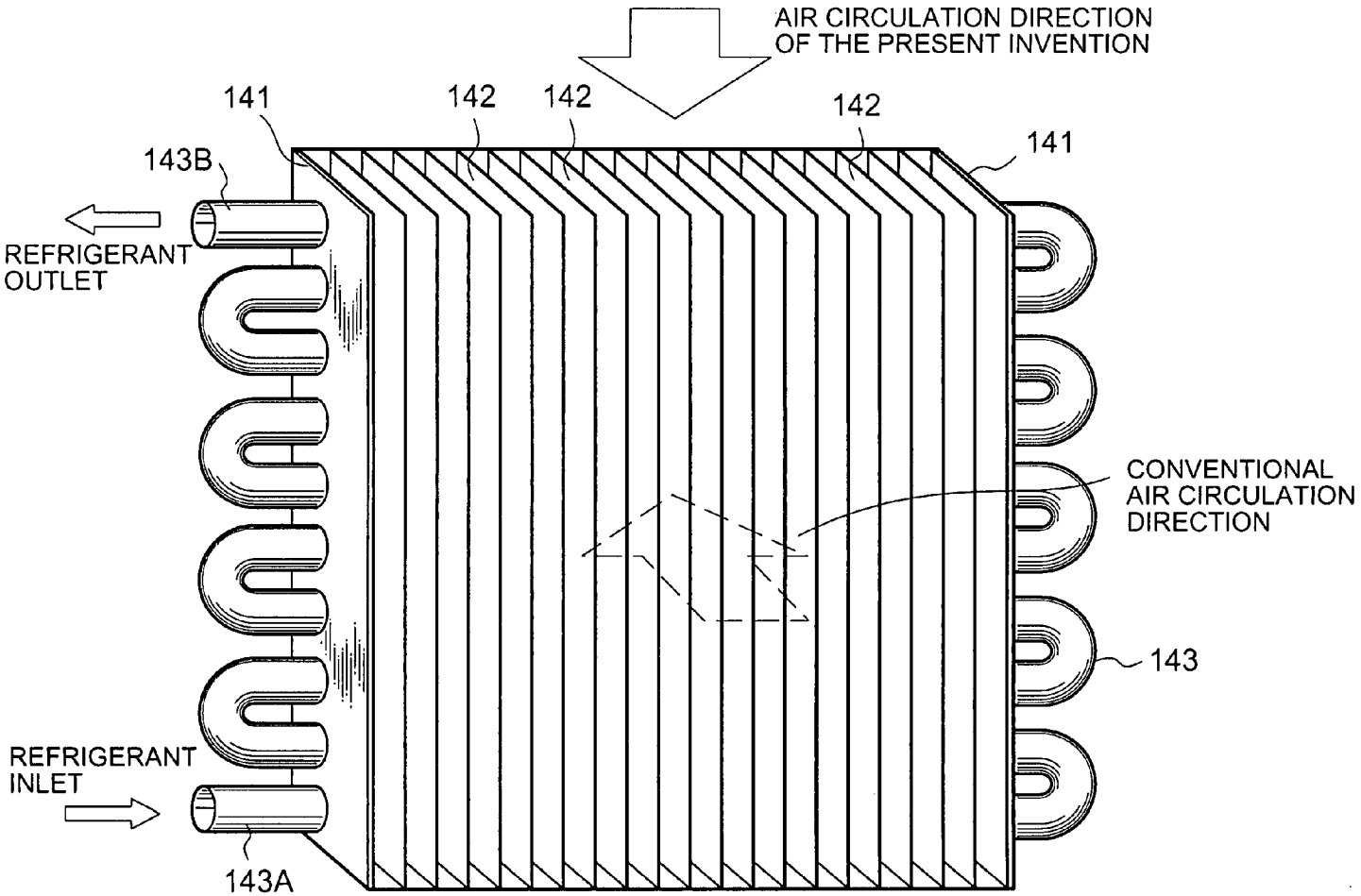
FIG. 3 is an enlarged view of an evaporator of the washing/drying machine.

Moreover, as shown in FIG. 3, when the air is passed in the length directions of the fins 142 . . . of the evaporator 24 by the blower 75, the air can more efficiently exchange the heat using the whole evaporator 24.

Furthermore, when the air is circulated downwards from above into the evaporator 24, dew condensation water attached to the evaporator 24 easily flows downwards. The dew condensation water is smoothly discharged.

In general, a performance of the washing/drying machine 100 including the refrigerant circuit 20 can also be enhanced.

Next, an operation of the washing/drying machine 100 constituted as described above will be described. The things to be washed and a predetermined amount of washing powder corresponding to an amount of the things to be washed are thrown into the accommodating chamber 10 in the inner drum 5. When a power switch and a start switch are operated among the above-described operation switches, the control device starts a washing operation. Moreover, the control device opens the water supply valve of the water supply passage (not shown) to open the water supply passage. Accordingly, water is supplied into the accommodating chamber 10 of the inner drum 5 in the outer drum 2 from the water source. It is to be noted that the draining valve 13 of the draining passage 12 is closed by the control device.

When a predetermined amount of water is accumulated in the accommodating chamber 10 in the inner drum 5, the control device closes the water supply valve to close the water supply passage. Accordingly, water supply from the water source is stopped.

Next, the driving motor formed in the side surface of the main body 1 is energized/started by the control device to rotate the shaft 8, accordingly the inner drum 5 attached to the shaft 8 starts rotating in the outer drum 2, and a washing process of the washing operation is started.

When a predetermined time elapses from the start of the washing process, the driving motor is stopped by the control device, and the draining valve 13 of the draining passage 12 is opened to discharge the water (washing water) in the accommodating chamber 10 (i.e., in the outer drum 2) of the inner drum 5.

Moreover, when the water in the accommodating chamber 10 of the inner drum 5 is discharged, the control device operates the driving motor again to spin-dry the things to be washed. After performing the spin-drying for a predetermined time, the control device closes the draining valve 13 of the draining passage 12.

Next, the control device shifts to a rinsing process, and opens the water supply valve of the water supply passage to open the water supply passage. Accordingly, the water is supplied to the accommodating chamber 10 in the inner drum 5 from the water source again.

When a predetermined amount of water is supplied to the accommodating chamber 10 in the inner drum 5, the control device closes the water supply valve to close the water supply passage. Accordingly, the water supply from the water source is stopped.

Moreover, after a rotation operation of the driving motor is repeated for a predetermined time to perform the rinsing, the control device stops the driving motor, and opens the draining valve 13 of the draining passage 12 to discharge the rinsing water in the accommodating chamber 10 to the draining passage 12. When the rinsing water in the accommodating chamber 10 is discharged, the control device operates the drying motor again, rotates the inner drum 5 in the same manner as described above, and shifts to a spin-drying process to spin-dry the things to be washed.

After performing the spin-drying process for a predetermined time, the control device closes the draining valve 13, and starts the operation of the blower 75. Moreover, the drying motor rotates the inner drum 5, and the process shifts to a drying operation. In the drying operation, a high-temperature/pressure refrigerant gas discharged from the compressor 21 radiates the heat in the gas cooler 22, and thereafter the pressure of the gas is reduced by the expansion valve 23. Next, the refrigerant flows into the evaporator 24 to absorb the heat from a periphery thereof, evaporates, and is drawn in a first rotation compression element of the compressor 21 from the refrigerant discharge pipe 32. The refrigerant is circulated in this manner (white arrow of FIG. 1).

By the operation of the blower 75, the air heated by the heat radiation of the high-temperature/pressure refrigerant in the gas cooler 22 at a high temperature flows out into the hollow portion 9 from the duct member 67 of the air circulation path 72, and is blown into the accommodating chamber 10 of the inner drum 5 (arrow G of FIG. 1).

Moreover, as described above, the circulation direction of the air passed through the gas cooler 22 and that of the refrigerant flowing in the gas cooler 22 form the counter-flow. Therefore, the temperature difference between the air in the process of the passage through the gas cooler 22, and the gas cooler 22 is substantially constant, the air can efficiently exchange the heat with the refrigerant, and the air blown into the accommodating chamber 10 can be easily set at a predetermined high temperature.

On the other hand, the heated air blown into the accommodating chamber 10 warms the things to be washed accommodated in the inner drum 5 (accommodating chamber 10) to evaporate moisture, and the things to be washed are dried. The moisture-containing air which has dried the things to be washed flows through the accommodating chamber 10, flows out of the inner drum 5 via through holes (not shown), flows through the duct member 68 of the air circulation path 72, is drawn into the air passage 69 from the inlet 69A (arrow A of FIG. 1), and flows through the evaporator 24 disposed therein (arrow B of FIG. 1).

Here, the moisture (moisture evaporated from the things to be washed) contained in the air from the accommodating chamber 10 coagulates on the surface of the evaporator 24 in the process of the passage through the evaporator 24, and drops as water droplets. The water droplets which have dropped are discharged to an external drain ditch and the like from the draining passage 12 via a drain pipe (not shown). At this time, the air is passed downwards from above in the evaporator 24, and therefore the water droplets smoothly drop, and are discharged.

The dried air from which the moisture has been removed by the evaporator 24 next flows into the gas cooler 22, and is heated (arrow C of FIG. 1). Moreover, the air flows out of the outlet 69B of the air passage 69 to enter the duct member 67 (arrow D of FIG. 1), is drawn in the blower 75, blown in the shaft 8 on the side of the hollow portion 9 (arrow E of FIG. 1), and blown into the accommodating chamber 10 in the inner drum 5 (arrow G of FIG. 1). The moisture is taken from the things to be washed in the inner drum 5, and they are dried. This circulation is repeated.

When the drying operation is performed for a predetermined time in the control device, the things to be washed in the accommodating chamber 10 in the inner drum 5 are completely dried.

When the air in the air circulation path 72 is heated by the gas cooler 22, and dehumidified by the evaporator 24 in this manner, the air can be efficiently heated.

Moreover, the refrigerant, for example, carbon dioxide which sets the schematic pressure on the high pressure side of the refrigerant circuit is used as described above, and the passed air and refrigerant in the gas cooler 22 flow in the opposite directions. Accordingly, the temperature difference between the air in the process of the passage through the gas cooler 22, and the gas cooler 22 can be substantially constant, and the heat exchange efficiency between the air and the refrigerant in the gas cooler 22 can be improved.

Furthermore, the gas cooler 22 and the evaporator 24 are constituted of the fin and tube type heat exchangers, and the air is passed in the length directions of the fins 122, 142 of the gas cooler 22 and evaporator 24 by the blower 75. Therefore, the air can efficiently exchange the heat with the refrigerant using the whole gas cooler 22 and evaporator 24.

In general, the heat exchange efficiency between the air and the refrigerant in the gas cooler 22 and the evaporator 24 is remarkably improved, and the drying time of the things to be washed in the washing/drying machine 100 can be further shortened.

It is to be noted that the fin and tube type heat exchangers are used in the gas cooler 22 and the evaporator 24 in the present embodiment, but the present invention is not limited to this embodiment, and is effective even with the use of another type of heat exchanger.

Moreover, in the present embodiment, the rotary compressor of the inner intermediate pressure type multistage (two-stage) compression system including the first and second rotation compression elements is used, but the compressor usable in the present invention is not limited to this rotary compressor.

What is claimed is:

1. A drying machine comprising:

an accommodating chamber in which things to be dried are accommodated and in which a drying operation of the things to be dried is performed;

a refrigerant circuit in which a compressor, a radiator, a decompression device, an evaporator and the like are successively connected to one another in an annular form via a piping and in which carbon dioxide is used as a refrigerant and which has a supercritical pressure on a high pressure side thereof; and blower means for blowing air which has exchanged heat with the radiator into the accommodating chamber to allow the air passed through the accommodating chamber to exchange the heat with the evaporator, wherein the blower means constitutes a circulation direction of the air passed through the radiator, and a circulation direction of the refrigerant flowing in the radiator in such a manner as to form a counter-flow.

2. The drying machine according to claim 1, wherein the circulation direction of the air passed through the radiator is directed upwards from below, and the circulation direction of the refrigerant flowing in the radiator is directed downwards from above.

3. A drying machine comprising:

an accommodating chamber in which things to be dried are accommodated and in which a drying operation of the things to be dried is performed;

a refrigerant circuit in which a compressor, a radiator, a decompression device, an evaporator and the like are successively connected to one another in an annular form via a piping and in which carbon dioxide is used as a refrigerant and which has a supercritical pressure on a high pressure side thereof; and blower means for blowing air which has exchanged heat with the radiator into the accommodating chamber to allow the air passed through the accommodating chamber to exchange the heat with the evaporator, wherein the blower means constitutes a circulation direction of the air passed through the evaporator, and a circulation direction of the refrigerant flowing in the evaporator in such a manner as to form a counter-flow.

4. The drying machine according to claim 3, wherein the circulation direction of the air passed through the evaporator is directed downwards from above, and the circulation direction of the refrigerant flowing in the evaporator is directed upwards from below.

5. The drying machine according to claim 1, 2, 3, or 4, wherein the radiator and the evaporator are constituted of fin and tube type heat exchangers, and the air is passed in length directions of fins of the radiator and the evaporator by the blower means.

* * * * *